United States Patent [19]

Popard et al.

[11] 4,417,183

[45] Nov. 22, 1983

[54] INCANDESCENT LAMP DRIVER CIRCUIT

[75] Inventors: Earl E. Popard, LaPuente; Michael F. Sedlar, Walnut; Gary W. Davidson, Upland, all of Calif.

[73] Assignee: Honeywell Inc., Minneapolis, Minn.

[21] Appl. No.: 394,062

[22] Filed: Jul. 1, 1982

[51] Int. Cl.[3] ..... H05B 39/02

[52] U.S. Cl. ..... 315/291; 315/208; 315/240; 315/311; 324/414

[58] Field of Search ..... 315/129, 135, 136, 208, 315/240, 291, 307, 311, 360, 362; 116/202; 323/908, 242, 243; 307/135, 157; 340/641; 324/414

[56] References Cited

U.S. PATENT DOCUMENTS 3,903,454 9/1975 Matsui et al. ..... 315/291 X 3,938,000 2/1976 Higashide ..... 315/208 X

*Primary Examiner*—Eugene R. Laroche

*Attorney, Agent, or Firm*—Roger W. Jensen

[57] ABSTRACT

Incandescent lamp driver circuit with current surge limiting and built-in test features.

7 Claims, 6 Drawing Figures

5.0 Volts
0 Volts
$V_{IN}$
3.9 Volts
30 MS
0 Volts
$V_A$
28 Volts
1.1 Volts
$V_{OUT}$
I MAX
230 MA
20 MS
160 MA
0 MA
$I_{OUT}$
2.4-5.0 Volts
25 MS
2 MS
0 Volts
$V_{TST}$

INCANDESCENT LAMP DRIVER CIRCUIT

BRIEF DESCRIPTION OF THE INVENTION

This invention relates to an incandescent lamp driver circuit with surge limiting and built-in test features. The primary function of an incandescent lamp driver circuit is to light an incandescent lamp by applying an appropriate voltage across the lamp terminal. Such a function is often required by computer or logic driven systems, and hence logic circuitry compatibility is desirable.

Due to the filament characteristics of an incandescent lamp, turn-on or "inrush" current is approximately ten times the lamp's steady state current. This well known phenomina has resulted, in the past, with a number of schemes for current surge protection; such protection arrangements are often incorporated into incandescent lamp driver circuits to accommodate this inertial surge of current, to protect the driver circuit from damage and to minimize coupling of the current pulse to adjacent, sensitive circuits. One prior scheme was to utilize ballast resistors in series with the filament of the incandescent lamp so as to maintain a small amount of current flowing through the lamp at all times. The problem with this is that high power dissipation of such ballast resistors often forces or requires that these resistors be mounted on a separate assembly. This in turn results in increased cost due to dual assemblies and interassembly wiring. Another prior arrangement is to clamp the lamp filament to a separate reference voltage so as to replace the ballast resistor; this arrangement would require a separate floating power supply which is a disadvantage. Another arrangement is to use a "current mirror" circuit to limit inrush current; this approach requires either a custom or hybrid driver design.

Another desirable feature in a lamp driver circuit is to have some means for verifying lamp operation or integrity. Prior arrangements have incorporated a "lamp test" button or a command which causes all lamps to be energized. This type of test consumes a great deal of power and fails to identify the faulted assembly, be it the driver circuit or the lamp.

The present invention employs a ramping technique which limits the rate at which the lamp current may change. Slowing down the leading edge of the turnon current allows the lamp to become warm before the full current capacity of the driver circuit is available, therefore inhibiting or eliminating the surge effects due to turning on a cold lamp. The use of a ramp technique also allows the circuit to accommodate lamps of various voltage ratings without changing circuit parameters, whereas other techniques would not accommodate this full range. The present invention easily incorporates a built-in test feature which permits the identification of a fault in the driver circuit and/or in the lamps per se.

DETAILED DESCRIPTION OF THE INVENTION

Figure 1:
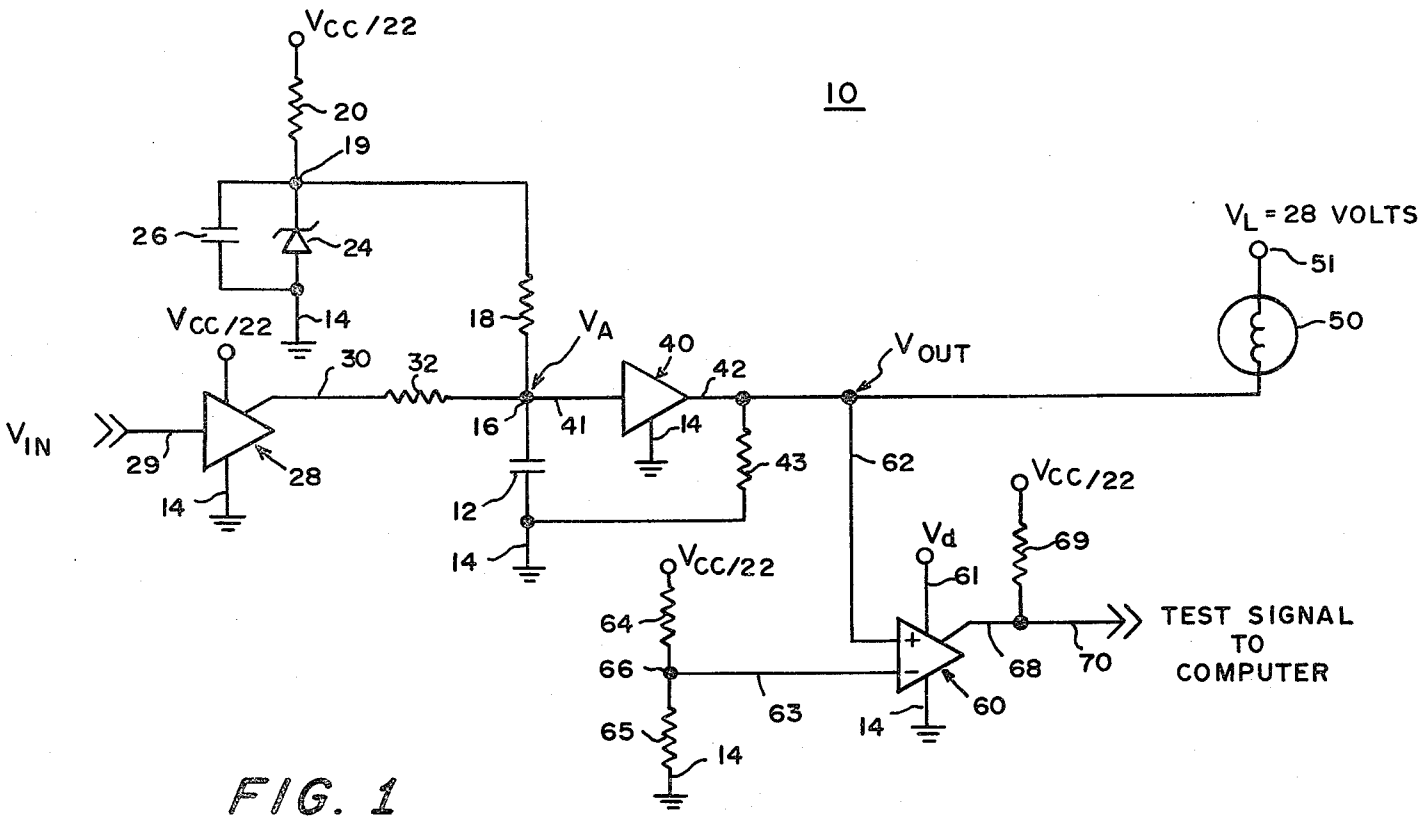
FIG. 1 shows a schematic diagram of the preferred embodiment of the present invention.

Referring to FIG. 1, the complete circuit incorporating an incandescent lamp voltage circuit with surge limiting and built-in test provisions is designated by reference numeral 10.

A capacitor 12 is connected between a junction point 16 and ground 14. A first resistor means 18 is connected between said junction point 16 and a second junction point 19 which also is a 3.9 volt reference voltage, such reference voltage is generated from a source of voltage $V_{cc}$/22, a resistor 20 connected between 22 and junction 19, a zener diode 24 connected between ground 14 and junction 19 and another capacitor 26 connected in parallel with the zener diode 24.

Figures 2A, 2B, 2C, 2D, 2E:
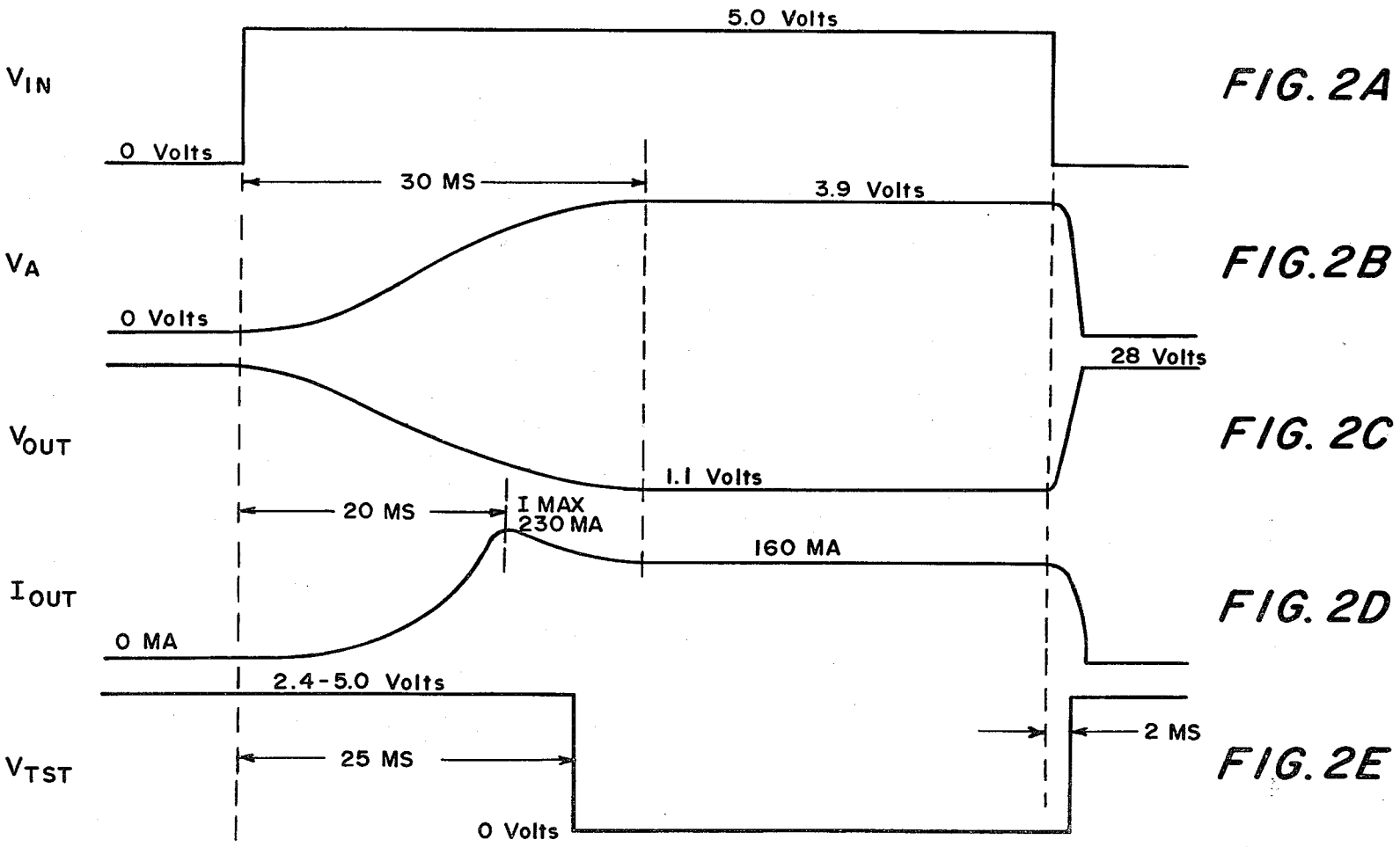
FIG. 2A through FIG. 2E show wave forms of output current and several relevant voltages associated with the circuit of FIG. 1.

A first electronic switch means 28 having a ground connection 14, an input 29, and an output 30, is adapted to receive at the input 29 thereof an input voltage $V_{in}$, the wave form for which is depicted in FIG. 2A. It will be noted from FIG. 2A that the $V_{in}$ varies between 0 volts and 5.0 volts. The first electronic switch means 28 is characterized as a TTL buffer. This means that $V_{in}$ may vary between 0 volts and 5.5 volts with ON meaning $V_{in}$ is between 2.4 and 5.5 volts and OFF meaning $V_{in}$ is between 0 and 0.6 volts. This TTL buffer may be catalog number 7407 integrated circuit of the type made by many integrated circuit manufacturers. The first electronic switch means is characterized by including means for responding to an "on" signal causing such switch means to have an "open" state at the output 30 thereof and also having means for responding to an "off" signal causing said switch means to have a "closed" state, i.e., said output being connected to said ground connection during the so-called "closed" state. Referring to FIG. 1, it is seen that the output 30 from the switch means 28 is connected via a resistor 32 to the first junction 16. Thus, when an off signal is applied to the input 29 of the switch means 28, then junction point 16 is effectively grounded to the switch means so as to prevent any charging of the capacitor 12. However, when an "on" signal such as the 5.0 volt signal depicted in FIG. 2A is applied to the input 29 of the switch means 28, then the switch functions or responds to its open state so as to remove the ground from the junction point 16. At this point, capacitor 12 then is permitted to charge through resistor 18 from the reference voltage established from junction point 19. The voltage build-up at junction point 16 which corresponds to the voltage at the top part of capacitor 12 as depicted in FIG. 1, is shown in FIG. 2B of the drawings. It will be noted that the voltage $V_a$ starts at 0 volts and then gradually builds up to a maximum of 3.9 volts over a time span of 30 milliseconds. Thereafter the voltage is steady at 3.9 volts until the end of the input "on" signal applied to the input 29 of switch means 28, i.e., at the end of the pulse the junction point 16 is once again grounded so as to discharge the capacitor 12. This is done quite rapidly through the switch means 28; however, the switch means 28 is protected against excessive currents through the action of resistor 32 which limits the current to a safe level.

A second electronic switch means 40 is provided having a ground connection 14 an input 41 connected to junction 16 and an output 42 connected to one side of an incandescent lamp 50 the other side of which is connected to a source of lamp voltage $V_L$/51; as indicated in FIG. 1 a nominal voltage for $V_L$ could be 28 volts. Electronic means 40 may be a Motorola MC1413 or a Sprauge ULN 2003; device 40 may also be identified as a Darlington Driver. A resistor 43 is connected between ground 14 and the output 42. FIG. 2C depicts the output voltage appearing at output 42 corresponding to the input depicted in FIG. 2A. Referring to FIG. 2C, it will be noted that the output voltage is normally at 28 when 0 voltage signal is applied at the input 29 of electronic switch 28. However, as the voltage at junction 16, i.e., $V_a$ increases as depicted in FIG. 2B, then the voltage at the output will decrease from a level of 28 volts down to a very low voltage depicted in FIG. 2C to D approximately 1.1 volts. This has the effect of permitting current flow through the incandescent lamp 50, such current being depicted in FIG. 2D as $I_{out}$. In FIG. 2D it will be noted that the current through the lamp starts at 0 and in a ramping function, increases to a maximum of about 230 milliamperes after a time elapse of approximately 20 milliseconds; thereafter the current decreases to a steady state value of about 160 milliamps and continues as long as the input voltage $V_{in}$ is applied to the input 29 of switch means 28.

The test means include a comparator such as an LM339 identified in FIG. 1 by the reference numeral 60 having a ground connection 14 and an input 61 connected to a source of reference voltage $V_d$. A pair of primary input leads 62 and 63 are provided for applying the output signal $V_{out}$ appearing at the output 42 of switch means 40 and a reference voltage respectively. To clarify, lead 62 is connected to lead 42 and lead 63 is connected to a junction 66 between a pair of series connected resistors 64 and 65 connected between reference voltage $V_{cc}/22$ and ground 14. The comparator 64 includes an output 68 upon which appears a test signal, the wave form for which is depicted in FIG. 2 of the drawing.

This test circuit will compare 63 against 42 with a digital output which is either "on" state meaning 68 is greater than 2.4 volts or in the "off" state meaning 68 is less than 0.6 volts with respect to ground 14. This feedback to the computer when combined with the known state of 29 will yield 1 of 4 states. State 1 is when 68 is on and 29 is on which is a normal state with no faults. State 2 is when 68 is off and 29 is off which is a normal state with no faults. State 3 is when 29 is on and the lamp is off, then the driver circuit has failed. State 4 is when 68 is on and 29 is off then the lamp has failed.

While we have shown the preferred embodiment of the invention, it should be understood that the invention is to be limited only by the scope of the following claims:

We claim:

1. Apparatus for supplying electrical energization to an incandescent lamp comprising:

(a) a capacitor connected between a junction point and ground;

(b) first resistor means connected between said junction point and a source of reference voltage;

(c) first electronic switch means having a ground connection and including means for responding to an "on" signal applied to an input thereof for causing said switch means to have an "open" state at an output thereof and means for responding to an "off" signal for causing said switch means to have a "closed" state, i.e., said output being connected to said ground connection;

(d) means connecting the output of said first electronic switch means to said junction point; and (e) second electronic switch means having a ground connection, an input and an output, said input being connected to said junction point, and said output being connected via an incandescent lamp, to a source of lamp energizing voltage, said second electronic switch means having an "open" state when no signal is applied to said input thereof, and a "closed" state, i.e., said output being connected to ground through said ground connection when a signal is applied to said input thereof, whereby when an "on" signal is applied to the input of said first electronic switch means, said capacitor means begins charging through said first resistor means toward the voltage of said source of reference voltage, to thereby apply a signal to the input of said second electronic switch means so as to cause a connection to be established between the output thereof and ground so that current begins to flow through said incandescent lamp.

2. Apparatus of claim 1 further characterized by said second electronic switch means being of the "Darlington Driver" type.

3. Apparatus of claim 1 further characterized by second resistor means being included in said connection means between said first electronic switch means and said junction point, whereby, when said first switch means has a "closed" state, said capacitor is discharged via said second resistor means and said first switch means to ground, said second resistor means providing current protection to said first switch means.

4. Apparatus of claim 1 further characterized by the values of said first resistor and said capacitor being selected so that at least approximately thirty milliseconds elapses during the charging of the capacitor.

5. Apparatus of claim 1 further characterized by said gradual charging of said capacitor producing a "ramping" effect on the current flowing through said incandescent lamp.

6. Apparatus of claim 5 wherein the maximum initial current flowing through said incandescent lamp is limited to a value no greater than approximately 1.5 times steady state value.

7. Apparatus of claim 1 further characterized by including additional testing means (a) connected (i) to said output of said second electronic switch means, and (ii) to a second source of reference voltage, (b) adapted to compare the voltage at said output of said second electronic switch means with said second source of reference voltage, and (c) adapted to signal failures of either said incandescent lamp or said second electronic switch means.

* * * * *